United States Patent [19]

DeLong

[11] 4,054,316

[45] * Oct. 18, 1977

[54] BENCH SEATS WITH END ALIGNING AND REINFORCING INSERTS

[76] Inventor: David C. DeLong, 1221 Broad St., Grinnell, Iowa 50112

[ * ] Notice: The portion of the term of this patent subsequent to June 1, 1993, has been disclaimed.

[21] Appl. No.: 664,668

[22] Filed: Mar. 8, 1976

Related U.S. Application Data

[63] Continuation-in-part of Ser. No. 519,601, Oct. 31, 1974, Pat. No. 3,960,405, which is a continuation of Ser. No. 326,600, Jan. 26, 1973, abandoned.

[51] Int. Cl.[2] ..... A47C 11/00

[52] U.S. Cl. ..... 297/248; 52/8; 108/64; 297/249

[58] Field of Search ..... 297/248, 249; 52/8, 52/9, 588; 248/235; 182/222, 223; 108/114, 64

[56] References Cited

U.S. PATENT DOCUMENTS

| | | | |
|---|---|---|---|
| 2,985,924 | 5/1961 | Burke | 52/8 |
| 3,482,874 | 12/1969 | Henebry et al. | 297/248 X |
| 3,554,142 | 1/1971 | Sorenson et al. | 248/235 X |
| 3,584,916 | 6/1971 | Bayes | 297/249 X |
| 3,657,854 | 4/1972 | Tipton | 52/8 |
| 3,960,405 | 6/1976 | DeLong | 297/248 |

FOREIGN PATENT DOCUMENTS

| | | | |
|---|---|---|---|
| 656,901 | 9/1951 | United Kingdom | 182/223 |
| 536,347 | 5/1941 | United Kingdom | 182/222 |

*Primary Examiner*—Roy D. Frazier
*Assistant Examiner*—Darrell Marquette
*Attorney, Agent, or Firm*—Warren H. Kintzinger

[57] ABSTRACT

An alignment structure for end-to-end positioned multi-channeled seats and footboards such as may be used for seating stadium stands. Channel shaped inserts positioned in adjacent front and rear channels of two end-to-end seat sections (or footboards) span the joint between the seat sections and extend endwise into each to maintain end-to-end alignment between the seat sections. Each channel shaped insert is anchored in one or the other of the end-to-end seat sections and permits expansion and contraction displacement movement between the seat sections.

5 Claims, 5 Drawing Figures

BENCH SEATS WITH END ALIGNING AND REINFORCING INSERTS

Figure 1:
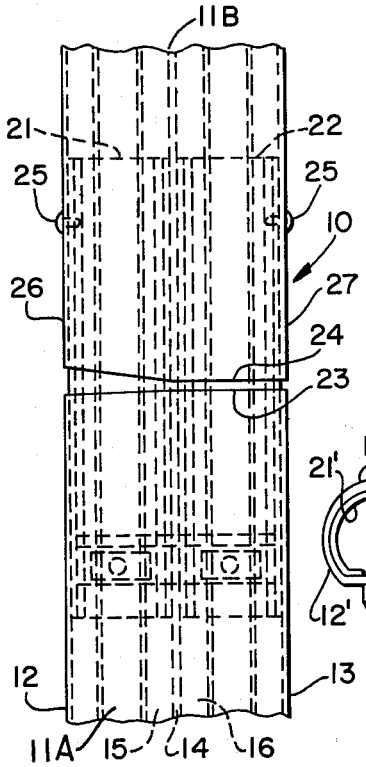

This application is a continuation-in-part of my copending application Ser. No. 519,601, filed Oct. 31, 1974, now U.S. Pat. No. 3,960,405; the latter a continuing application of my now abandoned application Ser. No. 326,600, filed Jan. 26, 1973.

This invention relates in general to stadium type seating section-to-section endwise alignment and, in particular, to a front and rear channel insert alignment system for end-to-end positioned seat sections.

It is important that end-to-end positioned elongate channeled stadium seats and footboards be joined together with a relatively smooth joint and remain in line year after year. Alignment should be maintained through seams in continuous row lengths, and expansion joints should be provided to insure alignment throughout expansion and contraction cycles brought on by heating and cooling. Misalignment at a seam has been a constant problem with pre-existing inadequate methods of securing two end-to-end positioned seat sections together over a seat support with a seam plate. This type of structure not only adds expense of bolts required to bolt it together and to the seat support, but also raises up the seat by the gauge thickness of the adapter seam plate to add to the misalignment problem. Further, when a seam plate is used other than over a seat support, as in the middle of a span between two seat supports, strength through the seam joint may be inadequate, marginal at best, and the alignment problem may still exist. When a customer calls for immediate delivery of aluminum plank for stadium seats in a length not stocked, the option heretofore was to either cut down longer lengths, thus producing undesired scrap, or ordering the exact piece count and cutting lengths from an extrusion producer, the latter option involving a procurement procedure generally involving a minimum of six weeks before shipment is made. Continuity in row length, where seating row lengths are curved to conform to the concrete curve at the risers, is desirable, however, there have been problems with miters used and excessive labor costs. Sharp edges at a joint seam of some seating plank units come into contact with either clothes or skin and can easily cut or tear material or skin. This is a hazard with misalignment at seams, particularly with the seam plate method of securing two seat planks together over a seat support, and with plank ends being separated either fore or aft. When butting two aluminum seating planks together the seam will be a perfect seam only if the plank extrusion supplier gives a perfect 90° cut on mating ends, a condition many times not achieved. End capping of seating plank ends and leaving, for example, a ½-inch gap spacing is one method that has been used with adjacent seating plank ends, obviously an expensive solution that still does not attain desired alignment and structural integrity.

It is, therefore, a principal object of this invention to attain improved alignment between end-to-end positioned seat and footboard extrusions.

Another object is to provide a safer and stronger stadium seat structure.

A further object is to cut material and labor costs in providing such improved seats.

Another object is more efficient use of stocked seating extrusions with minimized scrap.

Still another object is to achieve more prompt service on custom fabrication jobs through use of a dual channel insert alignment system for end-to-end positioned seat sections.

Another object is to eliminate any requirement for seat plank end miters with curved seat sections.

A further object is for seam gaps between end-to-end positioned seating extrusions to be bridged at the front and rear portions by dual channel inserts.

Still another object is for ease of assembly with channel inserts being inserted into front and rear channels in end-to-end positioned seating extrusions than would be the case with a single channel insert being positioned into and spanning end-to-end seating planks.

A further object is to limit the requirement for plank end caps solely to seating row ends.

Features of this invention useful in accomplishing the above objects include, in a front and rear channel insert alignment system for end-to-end positioned multi-channeled seating extrusions, seat extrusions with paralleled front and rear generally U-shaped channels. Relatively stiff elongate strong insert channel elements, usually of the same material as the seat extrusions, and respectively sized to fit the front and rear U-shaped channels of the seat extrusions, are inserted into the appropriate channels of two end-to-end positioned seat extrusions to bridge any gap at the end-to-end seam therebetween and structurally maintain good alignment between the seat extrusions. There is adequate overlap insertion into each respective seat extrusion channel to insure structural integrity, and each of the inserts is fixed in longitudinal position in one or the other of the end-to-end seat extrusions by a rivet or bolt extended through a channel wall of a seat extrusion and through a wall of the insert, so that the expansion and contraction movement in the structure is accommodated with endwise slippage of the insert in at least one of two aligned seat extrusion channels.

Specific embodiments representing what are presently regarded as the best modes of carrying out the invention are illustrated in the accompanying drawing.

Figure 2:
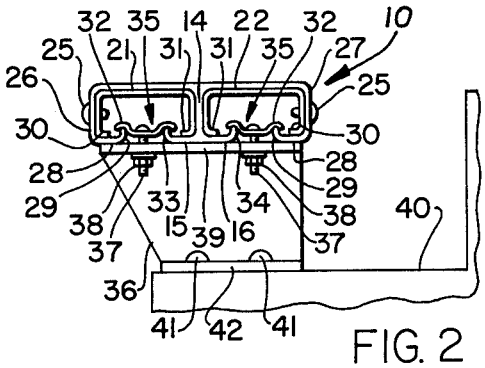
Figure 3:
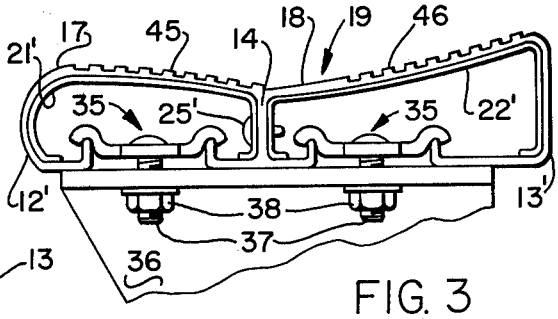
Figure 4:
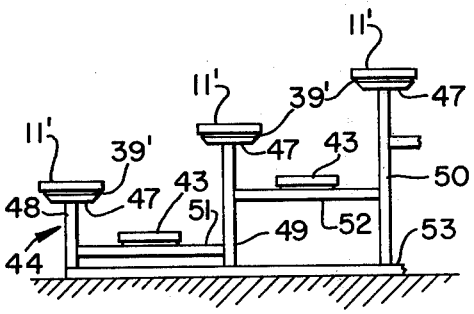
Figure 5:
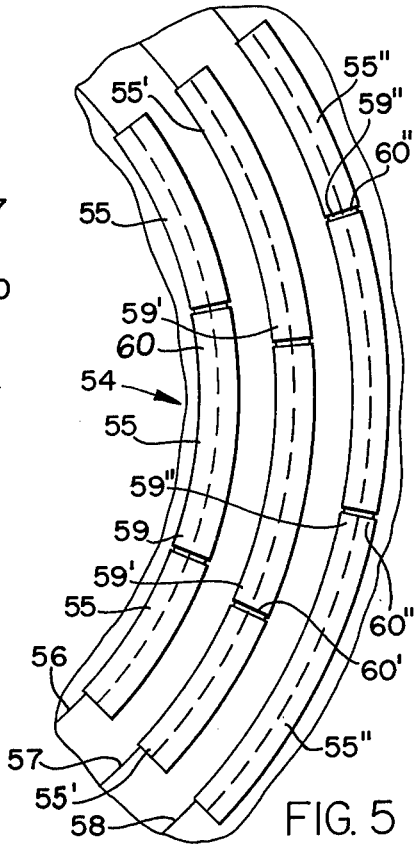

In the drawing:

FIG. 1 represents a partial top plan view of two end-to-end positioned seating plank extrusions having adjacent front and rear channels and a front insert and a rear insert in the channels and spanning the extrusion plank end-to-end seam;

FIG. 2, a partial side elevation of the seating plank extrusion assembly of FIG. 1 mounted on a concrete step section of a stadium;

FIG. 3, a partial side elevation of an anatomic contour seating plank embodiment used in place of the seating plank extrusions of FIGS. 1 and 2;

FIG. 4, a partial side elevation of a bleacher using seating planks such as those of FIGS. 1 and 2 that are also used as footboards; and FIG. 5, a partial top plan view of a curved stadium seat section using seating planks such as those of FIGS. 1 and 2 in curved form to match the curve of the stadium sections within which they are used.

Referring to the drawing:

The seating plank extrusion assembly 10 of FIGS. 1 and 2 is shown to include two extruded seating planks 11A and 11B formed with parallel front and rear underside channels 12 and 13. A common inner wall 14 of channels 12 and 13 has longitudinally extending and oppositely directed bottom lips 15 and 16. Front and rear underside channels 12 and 13 are essentially duplicates one of the other with the embodiment of FIGS. 1 and 2, while they may be individually shaped front and rear underside channels 17 and 18 as with the seating plank 19 embodiment of FIG. 3. In any event front and rear channel inserts 21 and 22 that are U-shaped channel elements are positioned in channels 12 and 13. The inserts 21 and 22, sized to be snug sliding fits within the channels 12 and 13, are positioned to span the seam between ends 23 and 24 of end-to-end positioned seating planks 11A and 11B and extend sufficiently far into both to maintain excellent alignment therebetween and give structural strength through the joint. Rivets 25 (or bolt structures) are inserted, respectively, through front and rear outer walls 26 and 27 of one or the other of the end-to-end seating planks, and the respective adjacent walls of the inserts 21 and 22, such that each insert is secured by a rivet 25 in but one of the two seating plank channels into which it is received.

Each of the front and rear underside channels 12 and 13 have bottom outer lips or webs 28 with upturned edge extensions 29, spaced inwardly from the lips 30 and 31 of front and rear channel inserts 21 and 22. Clips 32, shaped to fit over the tops of the edge extensions 29 and respective edge extensions 33 and 34 of inner channel lips 15 and 16 and span the space therebetween, are used as part of bolt-clip assemblies 35 used for securing seating planks 11A and 11B in place on seat supports 36. Bolts 37 of bolt-clip assemblies 35 extend to nuts 38 through the clips 32 and top flange 39 of seat supports 36 that are in turn mounted in place on a base 40 by mounting pins, bolts or rivets 41 extended through bottom flange 42 of seat supports 36. This is with base 40, a step molded concrete structure such as used in stadiums. It is of interest to note that bolt-clip assemblies 35 may be used with a seat support 36 substantially anywhere longitudinally along the end-to-end positioned seating plank 11A and 11B assembly with inserts 21 and 22 in the area of the inserts or not, as desired, without the inserts presenting any problems to such mounting. Bolt-clip assemblies 35 may even be used at, for example, the seam at seating plank ends 23 and 24, which are shown with an exaggerated irregular gap in FIG. 1 for illustrative purposes. The channel inserts 21 and 22 are positioned very advantageously for the purposes intended, giving desired alignment and structural support at the front and back channels of multi-channeled seating planks 11A and 11B. Further, the channel inserts 21 and 22 substantially fill the gap between plank ends 23 and 24 at the front and rear of the end-to-end seating planks to minimize catching and tearing of clothing and skin by sharp metal edges at what would otherwise be open cracks. Seating planks 11A and 11B now being supplied are extruded aluminum planks anodized when used as seats 11' and generally non-anodized when used as footboards 43 in the bleacher unit 44 of FIG. 4. Channel inserts 21 and 22 are much more easily fitted and assembled in place spanning seating plank ends than would be the case with a single large channel insert spanning the full width of seating plank inserts, besides being quite awkward to handle and insert would require the use of seating planks without an internal reinforcing rib defining dual channels as with the seating planks shown.

The channel inserts 21 and 22, as used in the assembly of FIGS. 1 and 2, advantageously facilitate use of random seating plank lengths and reduce scrap to an absolute minimum. The system of channel inserts permits more prompt service on custom field jobs, since the requirements can be filled with any lengths, and most of the cut sections can be utilized instead of scrapped. Obviously, this leads to optimization of inventory with more stocking of standard length planks and resultant savings to both the supplier and to the customer.

The insert seat plank assembly does not require that joints occur at seat supports. The inserts secure and maintain alignment without requiring critical adjustments, and the inserts extend through joints, acting as expansion joints for seat plank expansion and contraction with temperature variation. The insert assembly not only compensates for imperfectly cut seating plank ends (perfect 90° cuts are not always attained on stock seating planks) but also provides a neater assembled stadium seat appearance.

Seating plank extrusions with multi-channels open to the bottom can assume any number of configurations other than the straight planks 11A and 11B of FIGS. 1 and 2. The anatomic contour seat plank extrusion 19 of FIG. 3 is only one example of these additional embodiments. In FIG. 3 the front and rear underside channels 12' and 13' are of materially different shapes, rather than being of substantially the same cross-section as with channels 12 and 13 of FIG. 2, and, as a result, the front and rear channel inserts 21' and 22' are individually shaped to be snug sliding fits within channels 12' and 13'. Portions of this embodiment substantially the same as with that of FIGS. 1 and 2 are numbered the same, and some that are somewhat different are given primed numbers, and a complete explanation thereof is not repeated again as a matter of convenience. The extruded seating plank extrusion 19 is provided with external top surface fluted sections 45 and 46. A sleeve anchoring rivet 25' extends through the common central channel wall and internal walls of the channel inserts.

Referring again to the bleacher assembly 44 of FIG. 4, the seats 11' may be end-to-end seating plank 11A and 11B assemblies with inserts 21 and 22 of FIGS. 1 and 2 or the seat plank extrusion 19 of FIG. 3 mounted on a flange 39' of bleacher mounts 47 at the tops of vertical supports 48, 49 and 50, etc. The plank assembly extrusion 11A and 11B assemblies of FIGS. 1 and 2 may also be used as footboards 43 mounted on horizontal frame members 51 and 52, etc. of the bleacher assembly having a base 53 resting on a supporting surface.

The curved stadium seat section 54 of FIG. 5 utilizes an extruded seating plank extrusion such as seat planks 11A and 11B of FIGS. 1 and 2, or seat plank 19 of FIG. 3, or other multi-channeled seating plank extrusions. However, the seating plank extrusions 55, 55' and 55'', etc. used are formed with curves matching curvature of the seat steps 56, 57 and 58, etc. of the supporting structure in the stadium seat section 54. With this structure the inserts 59 and 60, 59' and 60', and 59'' and 60'' used are provided with matching curves respectively to the curvature of the seating extrusions where used. Inserts 59–60'' for front and rear seating plank channels are much more readily formed with a seat plank matching curve and more easily inserted in place than would be the case with one large insert spanning the internal front to rear width of seating planks.

Whereas this invention is here illustrated and described with respect to several specific embodiments hereof, it should be realized that various changes may be made without departing from the essential contributions to the art made by the teachings hereof.

I claim:

1. Mass seating equipment comprising end-to-end positioned, multi-channeled, elongate support planks with a support surface; a front channel and a rear channel in each of said elongate support planks, said front and rear channels having a common inner wall; channel inserts sized to be snug sliding fits inserted in the respective front and rear channels; anchor means for each of said channel inserts anchoring said inserts in an insert-receiving channel of one of each end-to-end pair of said support planks; said front and rear channels of said elongate support planks being partially open to the bottom between web lips extended from channel side walls; said channel inserts being channel-shaped with two sides and an interconnecting top, and open to the bottom by an extent greater than that defined by said channel web lips, and with the bottom extremes thereof being space-separated from the end extremes of said web lips; said channel inserts being of adequate length to extend into end-to-end positioned channels of said elongate support planks, with overlap in each giving structural alignment and mutual support to end-to-end positioned ones of said support planks; and mount means for said end-to-end positioned planks, said mount means including bolt-clip assemblies and fixed mounting flanges, said bolt-clip assemblies engaging only said web lips in a clamping action to said fixed mounting flanges through areas of channel insert overlap and through areas outside of channel insert overlap without bolt-clip assembly interference with said channel inserts; with said end-to-end positioned support planks mountable both as seat benches and as footboards; and with said end-to-end positioned planks positioned with an expansion gap between plank ends.

2. The mass seating equipment of claim 1, wherein said anchor means for each of said channel inserts comprises a pin element extended through channel walling of both an elongate support plank and the channel insert.

3. The mass seating equipment of claim 1, wherein said front and rear channel inserts are of substantially the same shape in transverse cross-section.

4. The mass seating equipment of claim 1, wherein said front and rear channel inserts are individually shaped to match front and rear channels of different shape in a contoured support plank extrusion mounted for seating.

5. The mass seating equipment of claim 1, wherein said end-to-end positioned support planks are formed with curves to match curvature of a stadium section where used; and said front and rear channel insert channels are formed with curves to match the channels where used.

* * * * *